US005435486A

United States Patent [19]

Gerlach et al.

[11] Patent Number: 5,435,486

[45] Date of Patent: Jul. 25, 1995

[54] BALLAST-FREE PERMANENT RAIL WAY HAVING RECESSED TIE WITH CENTRAL FASTENING ELEMENT

[75] Inventors: Rudolf Gerlach, Sigmaringendorf; Ralf Walter; Bernhard Schad, both of Augsburg; Günther Leykauf; Josef Eisenmann, both of München, all of Germany

[73] Assignee: Walter Bau-Aktiengesellschaft, Augsburg, Germany

[21] Appl. No.: 230,771

[22] Filed: Apr. 21, 1994

[30] Foreign Application Priority Data

Apr. 22, 1993 [DE] Germany ..... 43 13 105.0

[51] Int. Cl.[6] ..... E01B 1/00

[52] U.S. Cl. ..... 238/7

[58] Field of Search ..... 238/2, 7, 9, 84, 85

[56] References Cited

U.S. PATENT DOCUMENTS 4,232,822 11/1980 Hahn et al. ..... 238/7

4,262,845 4/1981 Lucas et al. ..... 238/7

4,616,395 10/1986 Farese et al. ..... 238/7 X

FOREIGN PATENT DOCUMENTS 2659163 7/1978 Germany .

4113566 10/1992 Germany .

*Primary Examiner*—Robert Oberleitner

*Assistant Examiner*—S. Joseph Morano

*Attorney, Agent, or Firm*—Antonelli, Terry, Stout & Kraus

[57] ABSTRACT

To make a ballast-free permanent rail way, an asphalt base is applied to a substructure comprised of concrete. Railway ties, which have a recess in the center on their underside, are laid on the asphalt base. In order to secure the ties against transverse forces and to assure accurate fitting and wear-free anchoring, the ties have a first bore in the center and the substructure has a blind bore. The blind bore is filled with an adhesive and then a dowel or a threaded rod is inserted into the blind bore which passes through a sliding spacer sleeve inserted into the first bore.

22 Claims, 2 Drawing Sheets

BALLAST-FREE PERMANENT RAIL WAY HAVING RECESSED TIE WITH CENTRAL FASTENING ELEMENT

FIELD OF INVENTION

The invention relates to a method for making a ballast-free permanent rail way and to a permanent rail way made according to this method.

BACKGROUND TO THE INVENTION

Ballast-free permanent rail ways are used in high speed track sections. Dynamic stresses from high speed trains act on the track and ties in an area in front of the travelling train which attempts to lift the track and ties. This is called "pumping" or "riding" of the track grating.

In order that the longitudinal and transverse forces acting on the track grating are absorbed by the substructure, it is known to rigidly connect the ties to the substructure. This can be accomplished by doweling, bolting or gluing the ties to the substructure or by embedding the ties in the substructure with concrete. Examples of doweling and bolting are shown in DE-A-26 59 161. These rigid connections between substructure and ties have problems due to the dynamic stresses. A relatively quick destruction of the connection substructure/tie results. The vibrations produced by the dynamic stresses are transmitted undamped to the substructure and to the travelling train.

A method of the aforementioned type is described in DE 41 13 566 A1. In this method, an asphalt base, which has a groove in the area of the center of the tie, is applied to a substructure consisting of concrete. A transverse force base, which consists of asphalt material and protrudes beyond the surface of the asphalt base, is embedded in this groove. This protruding part of the transverse force base engages in a recess in the mid area of the monoblock ties and thus absorbs the transverse forces acting on the ties. Transverse forces are thereby absorbed by the transverse force base, but it enables a pumping or riding of the track grating. However, it is necessary that the transverse force base engages in the recess without play on the underside of the tie, so that it is necessary to ensure that the transverse force base and this recess are made in such a way that they fit very accurately. Although it is possible in this method that the transverse forces are absorbed by the substructure, the behaviour of the longitudinal forces acting on the track grating are nevertheless a problem. These longitudinal forces can only be absorbed by the substructure due to the friction contact between ties and substructure which, however, is suspended when the ties lift from the substructure due to pumping of the track grating.

SUMMARY OF THE INVENTION

It is an object of the invention to improve the aforementioned method such that an accurately fitting and wear-free anchoring of the ties results.

In accordance with an embodiment of the invention, a method for making a ballast-free permanent rail way in which an asphalt base is applied to a substructure comprised of concrete and on which monoblock ties are laid which are provided with a recess in the center on their underside and which lie on both sides of this recess on the asphalt base and which are secured against transverse forces, is comprised of boring each tie with a first bore in is center, laying the respective tie, then making an additional bore leading to the substructure as a blind bore via the first bore, inserting an adhesive into the blind bore, and driving a fastener into the first bore to penetrate the bores whereby the wall of the first bore can be shifted in direction of the bore axis along the fastener.

In accordance with another embodiment a ballast-free rail way is comprised of an asphalt base disposed on a substructure of concrete, monoblock ties each containing a central recess on its underside and lying on both sides of the recess on the asphalt base, the ties being secured against transverse forces, a first bore in the center of each tie, an additional bore as a blind bore passing to the substructure via the first bore, an adhesive contained in the blind bore, and a fastener passing through both bores, whereby the wall of the first bore can be shifted in the direction of the bore axis along the fastener.

BRIEF INTRODUCTION TO THE DRAWINGS

Embodiments of the invention are explained in greater detail below, with reference to the drawings in which.

DETAILED DESCRIPTION OF THE INVENTION

Figure 1:
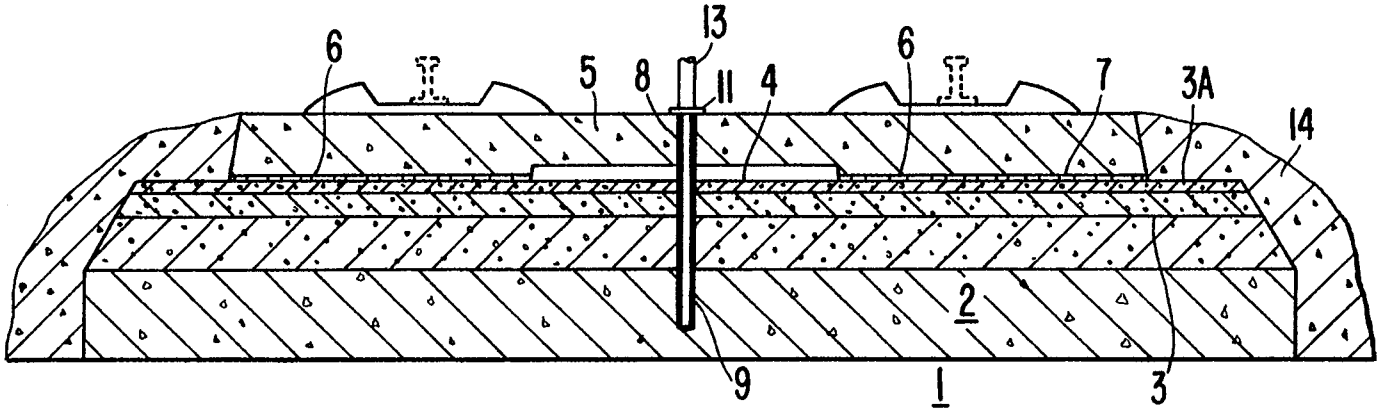
FIG. 1 is a central vertical section through a ballast-free permanent rail way.

A non-reinforced rolled concrete layer 2 is applied, in a thickness of up to 250 mm, to an anti frost layer 1 by means of a conventional asphalt street finishing machine. A multilayer asphalt base 3 is applied to this rolled concrete layer 2, also by means of a street finishing machine, the uppermost layer 3A of which consists of asphalt concrete. The thickness of this multilayer asphalt base is also up to 250 mm.

Monoblock ties 5, consisting of concrete, are now laid on this asphalt base 3. These concrete ties have a recess 4 extending over the entire width of the ties 5 in the center, on their underside, so that bearing surfaces 6 result on both sides of the recess 4. A geotextile 7 is laid between these bearing surfaces 6 and the asphalt concrete layer 3A.

A through-hole bore 8 is made in the area of recess 4, centrally to the longitudinal and transverse dimensions of the tie. This bore 8 is used as a gauge for a blind bore 9 to be made in the asphalt layer 3 and the rolled concrete layer 2 by means of a borer. The borings are then cleaned out of the blind bore 9. An adhesive, which was first mixed from the two components of a two-component adhesive, is inserted into this blind bore 9 via bore 8. It is also possible to insert a cartridge containing the two components into the blind bore 9, the components of which mix when the cartridge is pierced. A sliding spacer sleeve 11, having a collar 12 is now inserted into the tie bore 8, the sliding spacer sleeve 11 adjoining the wall of bore 8 so as to be force-locked and tolerance free and extending up to the upper edge of recess 4. A dowel 13 is then pressed into the blind bore 9 through this sleeve 11 which, when inserted in the blind bore 9, projects slightly beyond the upper edge of bore 8. When pressing the dowel 13 into blind bore 9, the adhesive rises and fills the gap between blind bore 9 and dowel 13. The amount of adhesive is selected in such a way that it emerges at the top out of the blind bore.

Alternatively, it is also possible to insert a cartridge 10 containing two components of the adhesive into the blind bore. When pressing the dowel, the adhesive cartridge is broken so that both components of the adhesive intermix and thus bind the adhesive.

Spaces between the individual prestressed concrete ties of the track grating are filled with cement or bitumen-bound, sound-absorbing material, e.g. with a monograin concrete. This material 14 is also filled into the areas on the side of the ties 5 and layers 2, 3, as shown in FIGS. 1 and 3.

Figure 2:
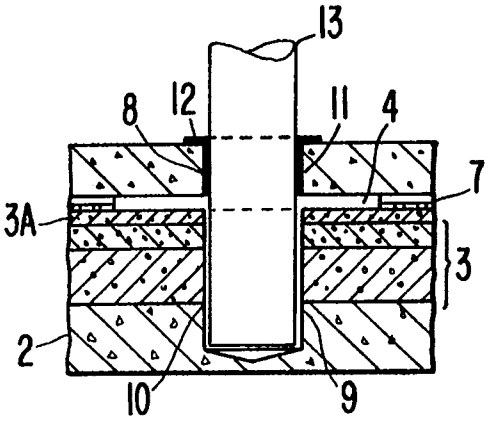
FIG. 2 is a detail in the region of the dowel.
Figure 3:
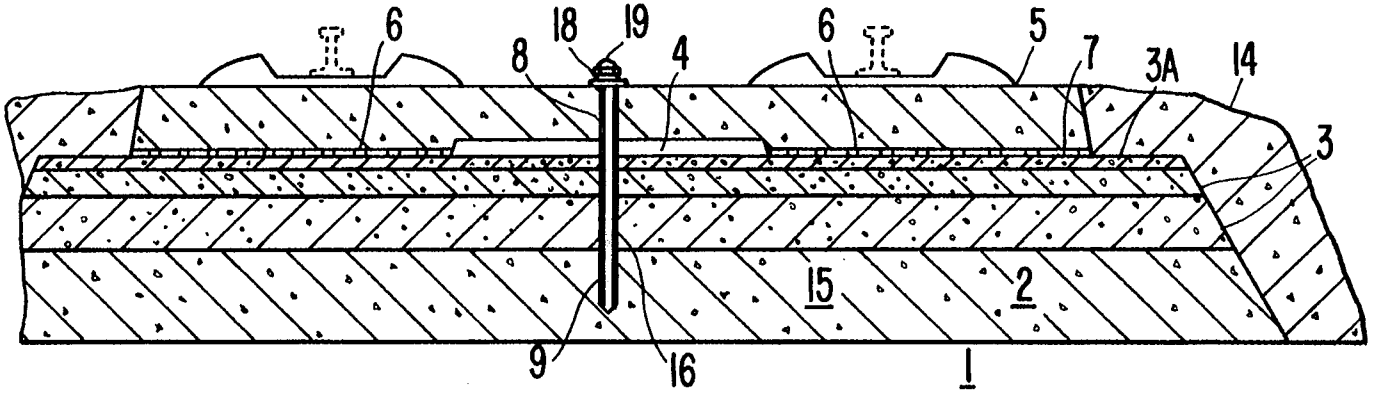
FIG. 3 is a section corresponding to FIG. 1.
Figure 4:
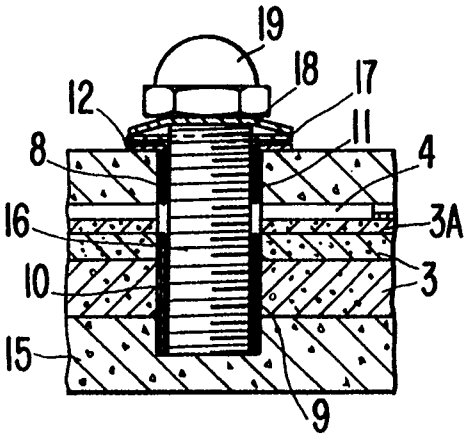
FIG. 4 is a detail in the area of the bolting.

The variation of the method, as shown in FIGS. 3 and 4, is explained below, whereby only the differences with respect to the method according to FIGS. 1 and 2 are dealt with.

Instead of the rolled concrete layer 2, a hydraulically bound base 15 (HBB) is used. A threaded rod 16 is now inserted, instead of a dowel 13, into the blind bore 9 filled with the cartridge. This threaded rod 16 projects beyond the upper end of the bore 8. A flat washer 17 and a cup spring plate 18 are now placed onto this protruding end and a cap nut 19 is then screwed on. The cup spring plate 18 enables the tie to move vertically.

The features of either of the embodiments can be interchanged, i.e. the dowel can be used in a base 15 and the threaded rod in a rolled concrete layer 2. When using a threaded rod, it is also possible to fill and adhesive into the blind bore.

The embodiments of the invention have in common that the tie can move upward in the presence of dynamic stresses with respect to the dowel or threaded rod, yet is still held perfectly on the side. In this way, pumping of the track grating is possible, i.e. the ties can also move upward. Transverse and longitudinal forces, which act on the track grating, are, on the other hand, absorbed by dowel 13 or threaded rod 16 and led into the substructure.

We claim:

1. A method for making a ballast-free permanent rail way in which an asphalt base is applied to a substructure comprised of concrete and on which monoblock ties are laid each of which is provided with a recess in the center on their underside and which lie on both sides of this recess on the asphalt base and which are secured against transverse forces, comprised of boring each tie with a first bore in its center, laying the respective tie, then making an additional bore leading to the substructure as a blind bore via said first bore, inserting an adhesive into the blind bore, driving a fastener into the first bore to penetrate the bores whereby the wall of the said first bore can be shifted in the direction of the bore axis along the fastener.

2. A method as defined in claim 1, including the step of inserting a two-component adhesive into the blind bore as said adhesive.

3. A method as defined in claim 2, including the step of inserting a cartridge, containing said two components of the adhesive.

4. A method as defined in claim 1, including the step of inserting a sliding spacer sleeve into the first bore prior to driving in the fastener.

5. A method as defined in claim 4, wherein the spacer sleeve is made of plastic material.

6. A method as defined in claim 4, including the step of inserting a two-component adhesive into the blind bore as said adhesive.

7. A method as defined in claim 6, including placing a geotextile on the asphalt base between adjacent bearing surfaces of the ties and the asphalt base.

8. A method as defined in claim 6, including filling the blind bore with a sufficient amount of adhesive to fill the entire gap between blind bore and the fastener so that the adhesive emerges from the top of the blind bore once the fastener has been driven in.

9. A method as defined in claim 1, including placing a geotextile on the asphalt base between adjacent bearing surfaces of the ties and the asphalt base.

10. A method as defined in claim 9, including surrounding the ties with a cement or bitumen-bound, sound-absorbing material.

11. A method as defined in claim 1, including surrounding the ties with a cement or bitumen-bound, sound-absorbing material.

12. A method as defined in claim 11, including filling the space between adjacent ties with said material.

13. A method as defined in claim 11, including filling the blind bore with a sufficient amount of adhesive to fill the entire gap between blind bore and the fastener so that the adhesive emerges from the top of the blind bore once the fastener has been driven in.

14. A method as defined in claim 1, including filling the blind bore with a sufficient amount of adhesive to fill the entire gap between blind bore and the fastener so that the adhesive emerges from the top of the blind bore once the fastener has been driven in.

15. A ballast-free rail way comprising an asphalt base disposed on a substructure comprised of concrete monoblock ties each containing a central recess on their underside and lying on both sides of the recess on the asphalt base, the ties being secured against transverse forces, a first bore in the center of each tie, an additional bore as a blind bore passing to said substructure via said first bore, an adhesive contained in the blind bore, and a fastener passing through both bores, whereby the wall of the first bore can be shifted in the direction of the bore axis along the fastener.

16. A ballast-free rail way as defined in claim 15, wherein the fastener is a dowel which protrudes beyond the tie and along which the first bore is guided in a sliding manner.

17. A ballast-free permanent rail way as defined in claim 15, wherein the fastener is a threaded rod which protrudes beyond the tie and on which the first bore is guided in a sliding manner.

18. A ballast-free permanent rail way as defined in 17, including a nut screwed onto the threaded rod and a spring plate inserted between the tie and the nut.

19. A ballast-free permanent rail way as defined in claim 18, including a washer located below the spring plate.

20. A ballast-free permanent rail way as defined in claim 15, including a spacer sleeve disposed into the first bore, surrounding the fastener.

21. A ballast-free rail way as defined in claim 20, wherein the spacer sleeve contains a collar.

22. A ballast-free permanent rail way as defined in claim 20, the spacer sleeve ending on the upper edge of the recess.

* * * * *